US005629506A

United States Patent [19]

Harris et al.

[11] Patent Number: 5,629,506

[45] Date of Patent: May 13, 1997

[54] LOW VOLTAGE AC CONTACTOR INCLUDING HIGH RECOVERY VOLTAGE GAS SYSTEM

[75] Inventors: Lawson P. Harris, Scotia; Herman L. Finkbeiner, Rexford; Minyoung Lee, Schenectady, all of N.Y.

[73] Assignee: General Electric Company, Schenectady, N.Y.

[21] Appl. No.: 260,431

[22] Filed: Jun. 15, 1994

[51] Int. Cl.[6] ..... H01H 33/04; H01H 9/30

[52] U.S. Cl. ..... 218/48; 218/1; 218/43; 218/46; 218/85; 218/51; 218/146

[58] Field of Search ..... 218/1, 9, 15–21, 218/22, 30–40, 43–88, 90, 118, 149–151, 155–158, 146, 147; 361/1, 2, 3, 14; 200/275, 266; 335/195–201; 423/210–233, 419.1–427

[56] References Cited

U.S. PATENT DOCUMENTS

| | | | |
|---|---|---|---|
| 1,144,047 | 6/1915 | Merriam | 218/1 |
| 2,051,478 | 8/1936 | Hampton et al. | 218/23 |
| 2,345,375 | 3/1944 | Bennett | 218/52 |
| 2,347,052 | 4/1944 | Hobson | 218/81 |
| 2,824,194 | 2/1958 | Moorhead | 218/48 X |
| 3,997,746 | 12/1976 | Harper et al. | 218/149 |
| 4,465,910 | 8/1984 | Martin | 218/56 |
| 5,416,455 | 5/1995 | Moldovan et al. | 335/132 |

OTHER PUBLICATIONS

James D. Cobin, Ph.D., "Gaseous Conductors," Dover Publications, Inc., New York.

*Primary Examiner*—J. R. Scott

*Attorney, Agent, or Firm*—Donald S. Ingraham

[57] ABSTRACT

An AC contactor having a high recovery voltage strength includes a contact assembly and a high recovery voltage gas system coupled to the contact assembly. The contact assembly includes two contact pads per electrical phase, with one of the contact pads being attached to a positioning device that selectively disposes the contact pad between a closed circuit position and an open circuit position. The high recovery voltage gas system includes a thermal gas evolving medium for introducing a high recovery voltage strength gas into the gap between the contact pads, which gas has a high glow discharge cathode voltage fall value, as determined for silver-based contacts, of not less than about 300 volts, and typically greater than about 500 volts. The high recovery voltage strength gas typically comprises carbon monoxide, carbon dioxide, water vapor, or the like. The thermal gas evolving medium typically is as a Group IA carbonate (e.g., sodium bicarbonate), and is disposed in the contact assembly.

25 Claims, 2 Drawing Sheets

LOW VOLTAGE AC CONTACTOR INCLUDING HIGH RECOVERY VOLTAGE GAS SYSTEM

BACKGROUND OF THE INVENTION

Low voltage AC (alternating current) contactors are used in industrial and commercial applications to control power flow to electrical motor and lighting loads in circuits operating at 600 V RMS and below. High capacity contactors typically have two contact gaps in series per electrical phase, with each contact gap having two contact pads. Such contactors are commonly constructed to include a moveable bridge structure on which two electrically connected silver-based contact pads are positioned. The bridge is driven by a solenoid acting in opposition to a spring such that the bridge contacts can make and break contact, depending on the bridge position, with two corresponding fixed contacts disposed in a plastic enclosure to which the voltage supply and load supply leads are attached. When the bridge is moved such that the bridge contact pads are disposed in contact with the respective stationary contact pads the circuit is closed; to open the circuit the bridge assembly is moved to separate the bridge contact pads from the respective stationary contact pads. Due to the electrical arcing that occurs when the contact pads are moved to break the circuit, many high capacity contactors also have arc chutes in the plastic enclosure that are disposed in proximity to the contact pads to assist in circuit interruption.

In a typical circuit interruption of a single phase, the circuit starts with the contactor contacts closed, current flowing, and the source voltage almost entirely across the electrical load. The bridge is then moved, e.g., by de-energizing the solenoid which allows the spring to move the bridge so that a gap exists between the bridge contact pads and the stationary (or fixed) contact pads. This opening of the contact pads results in low voltage arcs appearing across the two contact gaps (per electrical phase) in series, but otherwise has little immediate effect because the 10 volt to 30 volt drop across the arcs is relatively small compared to the voltage available from the power source, and thus the current continues to flow, from cathode spots on a negative contact pad to anode spots on the corresponding contact pad in the pair, with the amount of current substantially the same as before the contacts were open. The arc currents interact with magnetic blowout structures which tend to push the arc to the arc chute structure; because the arc chute structure presents a high voltage drop, there is a tendency of the arc to remain across, or to return to, the now-open contact pads.

After the opening of the contact pads, ultimately the current drops to zero at some time less than half a period of the AC waveform. Current can begin flowing again, however, if a new arc is formed as the AC waveform goes to a non-zero value and new cathode spots are formed on the former arc anodes by transfer of the available voltage source from the load to the contactor. Such a voltage transfer happens quickly, in about half the period of the resonant (or ringing) frequency of the circuit, which is typically as long as about 50 μsec in a low to medium power circuit (e.g., about 10 KW to less than 100 KW) operating at a low voltage (≦600 V RMS) and as short as about 5 μsec in a medium to high power circuit (e.g., between about 100 KW to 1000 KW) operating at a low voltage (in higher power circuits, the impedance tends to be lower). The magnitude of the voltage available to reestablish the arc is determined by the product of the peak source voltage, the sine of the phase angle between the voltage and current at the zero current point, and an overshoot factor near unity. If the magnitude of this available voltage is sufficient, conduction is reestablished along a series of arc gaps through the contactor and the current flow will continue at least for another half-period of the power frequency; otherwise current flow in the circuit remains interrupted.

In high current capacity conventional contactors, arc chutes are disposed in the contactor near the contact pads and the contactor is designed so that magnetic forces tend to force an arc across the contact pads into the arc chute. Due to the higher voltage drops across the several plates disposed in series in the arc chute, current flow is reduced. The limitations of such devices operating in ambient conditions, however, have necessitated the use of the bridge structure with the dual contact pads as described above, as the corresponding two contact gaps in series per phase enable a given size of contactor to handle higher voltage circuits for voltages in the upper half (e.g., ≧300 V RMS) of the low voltage range.

To assure adequate current interruption capability, standard ratings for contactors have been established. For example, the National Electric Manufacturers Association (NEMA) has established general purpose standard ratings of sizes 00 through 9; these ratings pertain to contactors intended for use in switching service at RMS AC currents ranging from 9 to 2250 amperes and motor power rating from ¾ horsepower to 1600 horsepower, in single phase or three phase systems at voltages up to 600 volts RMS (as used in this context, "low voltage" is considered to be 600 volts or less). Similar standard ratings have been established by the International Electrotechnical Committee in Europe. Manufacture of contactors to meet the required performance standards, such as current carrying and interrupt capability, for different service voltages has thus far required the use of the dual-contact pad bridge. The dual contact bridge construction has manufacturing costs associated with the use of four silver based contact pads per phase; for example, between about 30% and 50% of the materials cost of the controller arises from the silver based contact pads. Further, the dual contact construction further imposes some operating limitations, such as limited heat dissipation.

It is an object of this invention to provide a reliable low voltage AC contactor having only two contact pads per phase for standard rating that requires four contact pads per phase in a conventional contactor.

It is a further object of this invention to provide a contactor having improved heat dissipation characteristics as compared with a contactor of the same standard rating that requires four contact pads per phase.

It is a still further object of this invention to provide a low voltage AC contactor having a controllable atmosphere in the gap between contact pads to enhance the high voltage recovery value of that atmosphere.

SUMMARY OF THE INVENTION

In accordance with this invention, an AC (alternating current) contactor having a high recovery voltage strength includes a contact assembly and a high recovery voltage gas system coupled to the contact assembly. The contact assembly includes a plurality of contact pads, at least one of the pads being attached to a contact pad positioning device that is moveably mounted so as to selectively dispose the positionable contact between a closed circuit position and an open circuit position; in the closed circuit position the positionable contact is disposed in electrical contact with another of the contact pads in the contact assembly and in the open circuit position the positionable contact pad is disposed away from that contact pad such that a gap exists therebetween. The high recovery voltage gas system comprises means for introducing a high recovery voltage strength gas into the gap between the contact pads, which gas has a high glow discharge cathode voltage fall value, as determined for silver-based contacts, of not less than about 300 volts, and typically in a range between about 450 volts and about 500 volts.

The high recovery voltage strength gas typically comprises carbon monoxide, carbon dioxide, water vapor, or the like. The means for introducing the high recovery strength voltage gas typically comprises a thermal gas evolving medium, such as a Group IA bicarbonate (e.g., sodium bicarbonate), disposed in the contact assembly. The thermal gas evolving medium is disposed in channels in the contact pads, or alternatively, in an arc chute disposed in the contactor assembly in a spaced relationship with the contact pads. The thermal gas evolving medium typically is a material having a thermal equilibrium profile such that upon heating the high recovery strength voltage gas is generated and upon cooling of the contact assembly following opening of the circuit, the gas is reabsorbed into the gas evolving medium. Alternatively, the means for introducing the high recovery strength voltage gas includes a gas source, such as a pressurized cylinder, coupled to the contact assembly via a gas admission apparatus, such as a thermally-activated quick acting valve.

The contactor of the present invention typically includes only two contact pads per phase due to the advantageous effects of the presence of the high recovery strength voltage gas after formation of the initial arc when the contact pads are moved to interrupt the circuit.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description in conjunction with the accompanying drawings in which like characters represent like parts throughout the drawings, and in which:

DETAILED DESCRIPTION OF THE INVENTION

Figure 1:
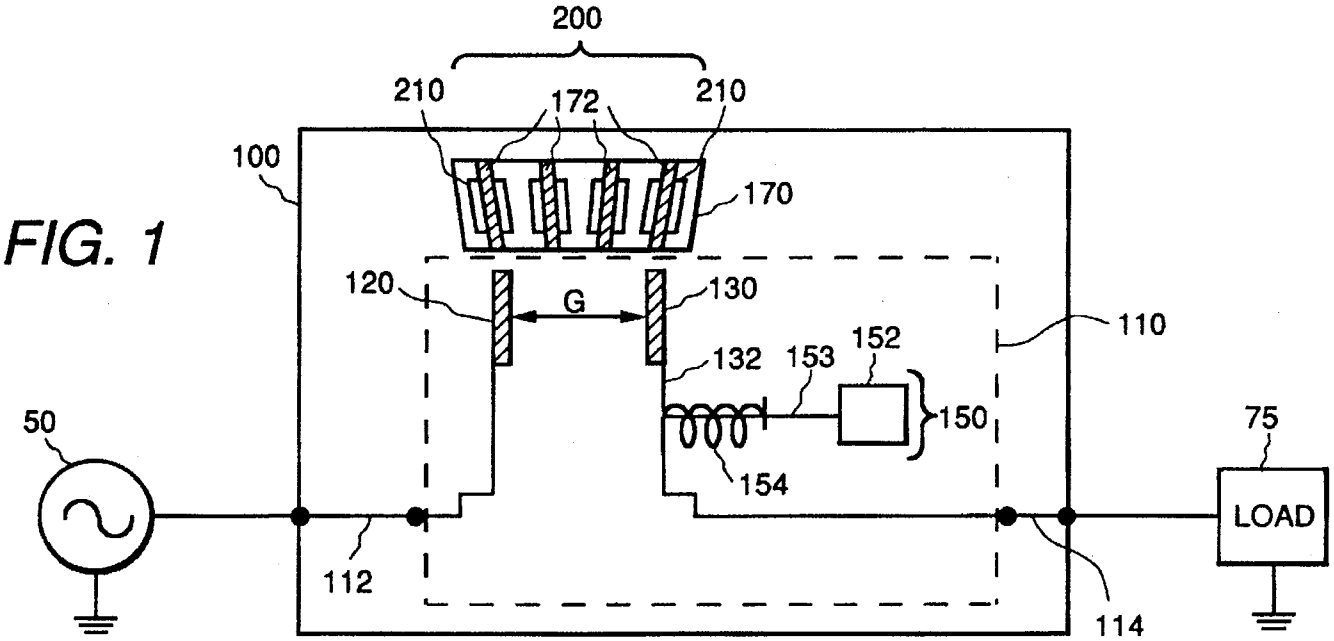
FIG. 1 is a partial schematic and partial block diagram of one phase of a contactor in accordance with one embodiment of this invention.

An electrical contactor 100 in accordance with this invention is coupled to an alternating current (AC) voltage source 50 and to an electrical load 75 so as to selectively connect load 75 to voltage source 50. AC voltage source 50 typically comprises a low voltage AC source, that is having a maximum voltage of about 600 volts RMS; voltage source 50 further typically operates at frequencies up to about 3 KHz, and commonly in the range of 50 Hz to 60 Hz. Load 75 typically comprises an electric motor or the like, such as an induction motor, to which AC electric power is selectively applied (that is, power is alternately turned on and off to the load). Controller 100 is adapted, as described below, to reliably connect and disconnect AC voltage source 50 with load 75 in accordance with this invention with the use of a controllable atmosphere in the gap between contact pads to enhance the high voltage recovery value of that atmosphere. As a consequence, fewer contact pads per phase are required in contactor 100 and the heat dissipation characteristics of the contactor are enhanced. One representative electrical phase of contactor 100 is illustrated in FIG. 1; for multiphase contactors, similar arrangements are provided for each electrical phase of contactor 100 (typically the contact pads for each phase are driven by a single mechanical actuator (e.g., a solenoid) in the contactor).

Contactor 100 comprises a contact assembly 110 electrically coupled via a source electrical connection line 112 to voltage source 50 and coupled via a load electrical connection line 114 to load 75. Contact assembly 110 comprises a source contact pad 120 coupled to source connection line 112, a load contact pad 130 coupled to load connection line 114, and a contact pad actuating mechanism 150 coupled to load contact pad 130 (as illustrated in FIG. 1) so as to selectively dispose load contact pad 130 between a position in electrical contact (e.g., in physical contact with) source electrical contact 120 and a position in which there is a gap "G" between the respective faces of source electrical contact pad and load electrical contact pad. An arc chute 170 is disposed in contactor 100 in a spaced relationship with contact assembly 110 so that an electrical arc formed upon movement of one (or, alternatively, both) contact pads 120, 130, can migrate into the arc chute.

Source contact pad 120 and load contact pad 130 typically are of identical construction, and comprise a silver-based material. As used herein, "silver based material" comprises a material comprising at least 40% by weight silver (Ag), and typically greater than about 80% by weight silver. The silver is typically mixed with a second material, for example a metal oxide such as cadmium oxide or tin oxide, or a metal such as nickel or the like. The second material typically comprises 7% to 20% by weight of the material that forms the contact pad; the cadmium oxide or other material added to the silver is mixed to produce a contact pad material having characteristics of low contact welding, high electrical conductivity, low contact erosion, and controlled arc stability. The physical dimensions of contact pads 120, 130, are typically determined based upon the current carrying capacity of the contact pad as required by the particular rating (NEMA or IEC rating) of contactor 100. For example, for a size 2 NEMA rating (45 A), silver based contact pads 120, 130, each respectively comprising about 90% silver by weight, typically have a circular shape with a diameter of about 9 mm.

Contact pad actuating mechanism 150 typically comprises a solenoid 152 or similar magnetic-drive mechanism disposed in opposition to a spring. As illustrated in FIG. 1, load contact pad 130 is coupled to a movable contact arm 132, which in turn is coupled to a solenoid shaft 153. By way of example and not limitation, actuating mechanism 150 is typically arranged such that upon energization of solenoid 152 solenoid shaft 153 is disposed in an extended position and in opposition to spring 154 such that load contact pad 130 is disposed in electrical and physical contact with source contact pad 120 so as to establish an electrical connection between voltage source 50 and load 75. Upon deenergization of solenoid 152, spring 154 disposes solenoid shaft 153 in a position such that contact arm 132 and contact pad 130 are disposed in a position such that gap "G" exists between load contact pad 130 and source contact pad 120. Other arrangements to effect the desired selective displacement of the contact pads with respect to one another are possible as is known in the art.

Arc chute 170 typically comprises a plurality of conductive plates 172 disposed to form an electrical path for an arc drawn into chute 170 (e.g., the plates are disposed substantially parallel to and in close proximity to one another such that arcs are formed in the gaps between plates (in series)). Typically magnetic blowout devices (not shown) are used to assist in directing an arc formed between load contact pad and source contact pad into arc chute 170, wherein the higher voltage drop of the arc between the plurality of plates 172 helps to stop current flow and increase recovery voltage strength following current dropping to zero.

In accordance with this invention, contactor 100 further comprises a high recovery voltage gas system 200 that is coupled to contact assembly 110 so as to introduce a high recovery voltage strength gas into gap "G" between contact pads 120, 130. As used herein, "high recovery voltage strength gas" refers to a gas that, when introduced into gap "G", has the effect of increasing the recovery voltage of the atmosphere in the gap such that the probability of reestablishment of an arc between contact pads 120, 130 is reduced from that expected if the remnants of ambient air and associated plasma from the preexisting arc were left in gap "G". The voltage at which an arc is reestablished is less than the cold breakdown voltage of the contactor because at the relevant time, a few microseconds after the current in the interrupted circuit drops to zero (in accordance with the normal waveform behavior), the arc gaps remain filled with residual plasma generated by the arc during the previous period of conduction. The recovery voltage is also sometimes referred to as a "withstand voltage", that is, the voltage that the atmosphere in the gap can withstand without breaking down in the formation of a new arc between contact pads 120, 130. The recovery voltage or withstand voltage as used above also corresponds to a high glow discharge cathode voltage fall value, as is measured for different gasses surrounding contact pads of particular material types. In accordance with this invention, the high recovery voltage strength gas has a high glow discharge cathode voltage fall value, as determined for silver-based contacts, of not less than about 300 volts, and typically in the range between about 450 volts and about 500 volts. The glow discharge cathode fall value in volts for silver based cathodes in air is 280 volts.

Examples of such high recovery voltage strength gasses include carbon monoxide (CO), carbon dioxide ($CO_2$), and water vapor ($H_2O$). It is thought that the presence of the complex molecules of these gasses in the gap "G" between contact pads serves to increase electron affinities and electron collision cross sections and thus prevent free electrons from accumulating enough energy from the electric field in the gap to cause ionization and electron avalanches leading to electrical breakdown of the atmosphere in the gap.

High recovery voltage gas system 200 comprises a means to introduce the high recovery voltage strength gas into the gap between contact pads 120, 130. Typically such means is passive, that is, there is no external equipment or sensing necessary to cause the introduction of the gas into the gap between the contact pads in order to effect the recovery strength voltage. For example, the high recovery voltage strength gas is generated by a thermal gas evolving medium, that is, a medium, such as a solid or a liquid (typically a powder) that evolves the desired gasses when heated. The heat necessary to cause the generation of the gas is provided by the arc formed when the contact pads are moved with respect to one another.

The thermal gas evolving medium typically comprises a material that is in thermal equilibrium at ambient temperatures so that under operating conditions in which no arc is present there is no significant evolution of gas, thus the gas evolving medium does not significantly decompose at the ambient temperature. The thermal gas evolving medium further has a thermal equilibrium profile that has a positive gradient; thus, as the temperature rises (e.g., from contactor normal operating temperature to several hundred degrees Centigrade), the equilibrium point of the medium and the evolved gasses changes such that more gas is generated. The desired thermal equilibrium profile is such that there is essentially no gas evolution from the medium at contactor operating temperatures (typically within about 40° C. of room temperature), and that sufficient gas is evolved to produce about one atmosphere or more pressure in the gap area at temperatures between about 100° C. and about 300° C.; further, the temperature at which the atmosphere or more pressure of gas is evolved from the medium is less than the melting point of the residual material of the medium.

The medium is disposed such that the evolution of the gas also results in introduction of the evolved gas into the gap between the contact pads. Further, the thermal profile of the medium also results in the gas evolved being absorbed back into the the medium when contactor assembly 110 cools after current flow is interrupted. Typically the contact assembly is not air tight but is enclosed such that no significant venting of the evolved gas takes place and thus the majority of the evolved gas is available to be reabsorbed in the medium. In this way the passive high recovery voltage system provides a long lasting, effective, and simple means of introducing the high recovery voltage gas.

One example of such a thermal gas evolving medium is sodium bicarbonate ($NaHCO_3$), which exists in a thermal equilibrium in accordance with the following equation:

$$2NaHCO_3 <> Na_2CO_3 + H_2O + CO_2$$

In this reaction, the evolved gasses provide about 1 atmosphere of pressure (760 mTorr) at about 100° C.; an increase of temperature results in a rapid change of the equilibrium of the reaction so that at about 110° C. the decomposition pressure is about 1150 mTorr. This increase in pressure from the rapidly-evolving gas is effectively used as a motive force to introduce the carbon dioxide and water vapor into the atmosphere between the contact pads. Another advantage of sodium bicarbonate (baking soda) is that the gas evolving medium is non-toxic and stable. Other Group IA metal carbonates are similarly known to thermally decompose to generate water vapor and carbon dioxide.

In one embodiment of the present invention, the thermal gas evolving medium is disposed in arc chute 170. For example, as illustrated in FIG. 1, a slab 210 of sodium bicarbonate paste (formed, e.g., by mixing the sodium bicarbonate with water to provide a viscous material) is disposed along sidewalls of arc chute plates 172. In this arrangement, when an arc is generated between plates of the am chute (following the establishment of an initial am between the contact pads) the thermal gas evolving medium (e.g., sodium bicarbonate) is heated by the arc. The heating of the thermal gas evolving medium results in the generation of carbon dioxide and water vapor, both of which are high recovery voltage strength gasses, that pass from the area between the plates in the arc chute into the gap between the contact pads. Alternatively, the thermal gas evolving medium can be disposed in enclosures coupled to the conductive plates in the arc chute so that the thermal gas evolving medium is exposed to heating when an arc is formed in the arc chute.

Figure 2B:
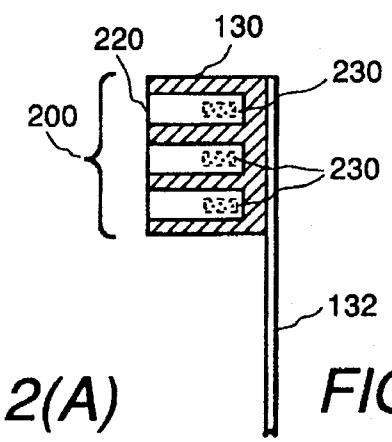
FIG. 2(B) a cross-sectional view of the contact pad of FIG. 2(A) taken along the lines I—I of FIG. 2(A).
Figure 2A:
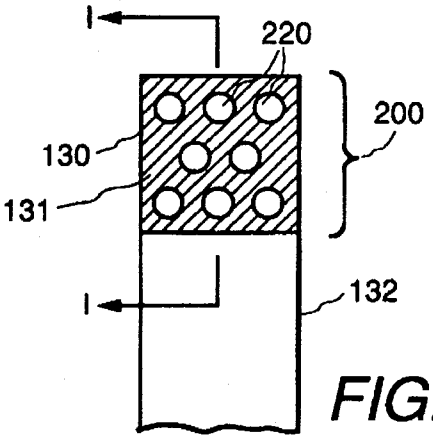
FIG. 2(A) is a plan view of a contact pad for a contactor in accordance with another embodiment of this invention.

Another embodiment of a passive high recovery voltage gas system 200 in accordance with this invention is illustrated in FIGS. 2(A) and 2(B), which are views of contact pad 130 attached to contact arm 132. A plurality of channels 220 are disposed in contact pad 130; typically these channels are open on face 131 of contact pad 130 (that is, the portion of contact pad 130 that is disposed in electrical contact with its corresponding contact pad to close the electrical circuit). The arrangement of channels 220 illustrated in FIGS. 2(A) and 2(B)is shown by way of illustration and not limitation; typically the diameter to depth ratio of the channels is about 1:3 and the channels are disposed in a pattern that provides uniform coverage of the contact face, with the channels taking up less than about one-half of the face surface area. A packet 230 comprising gas evolving medium is disposed in each channel 220, as illustrated in FIG. 2(B), so that, as the contact pad is heated by an am formed between two contact pads upon opening of the contacts, the high recovery voltage strength gas is evolved by the thermal gas evolving medium and the gas expands out of respective channels 220 and into the gap between the two contact pads. In this way the high recovery voltage strength gas is introduced directly into the gap. As noted above, sodium bicarbonate is readily used as a thermal gas evolving medium, as it is readily formed in packets 230 that can be inserted into channels 220 in contact pad 130.

Figure 3:
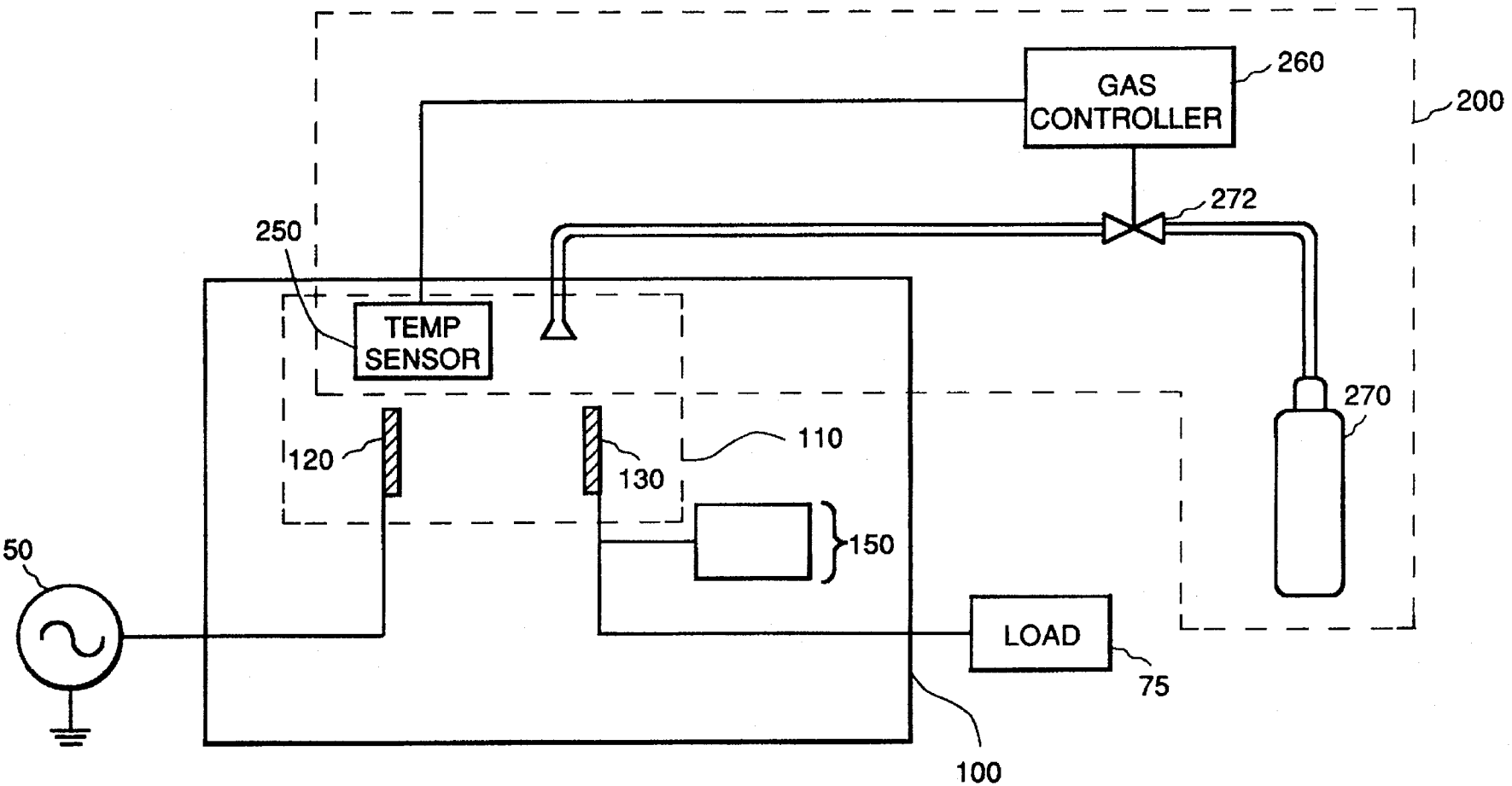
FIG. 3 is partial schematic and partial block diagram in accordance with a further embodiment of the present invention.

A still further embodiment of the invention is illustrated in FIG. 3. In this embodiment, an active high recovery voltage gas system 200 is used to introduce the high recovery voltage gas into the gap between the contact pads, that is, the system employs a gas source external to contact assembly 110 that is activated to introduce gas at selected times, such as when the temperature rises as a result of arc formation on opening of the contact pads. One example of such a system comprises a temperature sensor 250 disposed to detect a temperature corresponding to one or both contact pads in the contact assembly; temperature sensor 250 is coupled to a gas controller 260 which in turn is coupled to control gas flow via a control valve 272 from a gas source 270, such as tank of high recovery strength gas (e.g., carbon dioxide). In operation, a detected temperature from sensor 250 which corresponds to arc formation between contact pads 120, 130, is selected as a threshold at which gas controller 260 opens quick acting valve 272 to cause gas flow into contact assembly from gas source 270. A second selected temperature detected by sensor 250 corresponds to a temperature indicating contact assembly 110 is cooling after the arc has been extinguished, and is used to trigger controller 260 to stop the flow of gas into contact assembly 110 from gas source 270. Such a system, of course, depends upon periodic recharging the gas source 270 as the gas delivered to contact assembly 110 typically is not recovered.

In operation, the high recovery voltage gas system 200 of this invention causes the introduction of a high recovery voltage strength gas into the gap between contact pads. This gas has the effect of increasing the withstand voltage of the atmosphere in the gap between contact pads so that once current flow stops (as a result of the normal AC waveform), current flow is unlikely to be reestablished via another arc due to the presence of the high recovery strength gas in the gap (that is, it is less likely that the atmosphere in the gap will break down to allow the arc when the high recovery strength gas is present as compared to an atmosphere in which the gas has not been introduced). In passive gas systems having a thermal gas evolving medium with a selected thermal equilibrium profile, the medium is disposed in a reversible dispenser so that as the contact pads and ambient atmosphere begin to cool the high recovery strength gas is reabsorbed into the gas evolving medium. Recovery of a substantial amount of the high recovery strength gas can provide up to hundreds of thousands evolution/reabsorption cycles.

As a result of the enhanced current cutoff capability provided by high recovery voltage gas system 200 as noted above, a contactor of a given NEMA or IEC rating can readily be assembled that has only two contact pads per electrical phase as compared with the four contact pads per electrical phase that is commonly required in order to ensure current cutoff. Contactors having only two contact pads per phase are thus more readily fabricated and are more resource-efficient (especially with regard to silver-based contact pads) and economical to fabricate. Further, as each contact pad in such a contactor is coupled to a respective supply line or load line (that is, an external terminal and electrical cable to the load or source), heat dissipation is enhanced as heat generated in the contactor is able to be conducted away across both supply and lead lines, whereas in the conventional four contact pad design, heat from each contact pad pair can only be conducted in one direction, that is to the respective supply or lead line, because two of the contact pads are coupled to one another on the contactor bridge which provides no significant heat sink.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A low voltage AC contactor having a high voltage recovery capability and comprising:

at least one contact assembly comprising a plurality of contact pads and a contact pad positioning device, at least one of said contact pads being attached to said positioning device, said positioning device being moveably mounted so as to selectively dispose the positionable contact pad attached to said device between a closed circuit position wherein said positionable electrical contact is disposed in electrical contact with another of said plurality of contacts and an open circuit position wherein said positionable contact pad is disposed away from said another of said plurality of contacts such that a gap exists therebetween; and a high recovery voltage strength gas system coupled to said contact assembly, said gas system comprising means for introducing a high recovery voltage strength gas into said gap between said positionable contact and said another one of said plurality of contact pads;

said high recovery voltage strength gas having a high glow discharge cathode voltage fall value as determined for silver-based contacts not less than about 300 volts.

2. The contactor of claim 1 wherein said high recovery voltage strength gas comprises a gas selected from the group consisting of carbon monoxide, carbon dioxide, and water vapor.

3. The contactor of claim 1 wherein said high recovery voltage strength gas has a high glow discharge cathode voltage fall value greater than about 500 volts.

4. The contactor of claim 1 wherein means for introducing said high recovery voltage strength gas comprises a thermal gas evolving medium coupled to said contact assembly.

5. The contactor of claim 4 wherein at least one of said contact pads comprises channels therein and said thermal gas evolving medium is disposed in the contact pad channels.

6. The contactor of claim 5 wherein at least one of said contact pad channels opens onto a face of the respective contact pad across which electrical contact is made to a corresponding contact in said contact assembly when said positioning device is disposed in said closed circuit position.

7. The contactor of claim 4 wherein said contact assembly further comprises at least one arc chute disposed in a spaced relationship with said positioning device, and said thermal gas evolving medium is disposed in said arc chute.

8. The contactor of claim 7 wherein said thermal gas evolving medium is disposed on surfaces of said arc chute.

9. The contactor of claim 4 wherein said thermal gas evolving medium comprises a Group IA carbonate.

10. The contactor of claim 9 wherein said thermal gas evolving medium comprises sodium bicarbonate.

11. The contactor of claim 1 wherein means for introducing said high recovery voltage strength gas comprises a gas source coupled to said contact assembly via a gas admission apparatus.

12. The contactor of claim 1 wherein said contact assembly comprises only two contact pads per electrical phase.

13. A low voltage AC contactor having a high voltage recovery capability and comprising:

at least one electrical phase contact assembly comprising a first and a second contact pad and a contact arm to which said first contact pad is attached, said contact arm being moveably mounted in said contact assembly so as to selectively move said first contact pad between a closed circuit position wherein said first contact pad is disposed in electrical contact with said second contact pad and an open circuit position wherein said first contact pad is disposed away from said second contact pad such that a gap exists therebetween; and a passive high recovery voltage strength gas system coupled to each of said electrical phase contact assemblies so as to introduce a high recovery voltage strength gas into said gap between said first and second contact pads;

said high recovery voltage strength gas having a high glow discharge cathode voltage fall value as determined for silver-based contacts not less than about 300 volts.

14. The contactor of claim 13 wherein said recovery strength passive gas system comprises a thermal gas evolving medium.

15. The contactor of claim 14 wherein said thermal gas evolving medium comprises a Group IA carbonate material.

16. The contactor of claim 15 wherein said Group IA carbonate material is sodium bicarbonate.

17. The contactor of claim 14 wherein said thermal equilibrium profile of said thermal gas evolving medium has a positive gradient such that said gas evolving medium generates said high recovery voltage strength gas at pressures greater than about 1 atmosphere at temperatures greater than 100° F.

18. The contactor of claim 14 wherein at least one of said contact pads comprises a channel therein and said thermal gas evolving medium is disposed therein.

19. The contactor of claim 18 wherein each of said contact pads in each of said electrical phase contact assemblies comprises channels opening onto the face of said contact pad disposed in electrical contact with the other contact pad in said contact assembly.

20. The contactor of claim 14 wherein said contact assembly each further comprises an arc chute disposed in a spaced relationship with said contact arm such that an electric arc between said first and second contact pads formed upon movement of said first contact pad is drawn into said arc chute, and said gas evolving medium is disposed in said arc chute.

21. The contactor of claim 13 wherein said contactor comprises an 3-phase electrical contactor comprising three respective electrical phase contact assemblies.

22. The contactor of claim 13 wherein the maximum rated voltage of said contactor is not greater than about 600 volts RMS.

23. The contactor of claim 13 wherein each of said contact pads comprising at least 40% by weight silver.

24. The contactor of claim 23 wherein each of said contact pads comprises a mixture of silver and a second material, said second material being selected from the group consisting of metal oxides and nickel.

25. The contactor of claim 24 wherein each of said contact pads comprises a mixture of silver and cadmium oxide wherein said cadmium oxide comprises less than about 11% by weight.

* * * * *